United States Patent [19]

Ueyama et al.

[11] 4,356,782

[45] Nov. 2, 1982

[54] THREAD CHAIN SEWING METHOD AND DEVICE FOR USE IN THE TWO-NEEDLE OVERLOCK SEWING MACHINE

[75] Inventors: Yoshinari Ueyama, Osaka; Kikuo Mori, Kadoma; Hideo Matsushita, Kobe, all of Japan

[73] Assignee: Pegasus Sewing Machine Mfg. Co., Ltd., Japan

[21] Appl. No.: 162,656

[22] Filed: Jun. 24, 1980

[30] Foreign Application Priority Data

Mar. 14, 1980 [JP] Japan ..... 55-32908

[51] Int. Cl.³ ..... D05B 1/20; D05B 1/10

[52] U.S. Cl. ..... 112/197; 112/269.1

[58] Field of Search ..... 112/197–202, 112/262.1, 269.1, 163, 165, 166

[56] References Cited

U.S. PATENT DOCUMENTS 3,100,469 8/1963 Washburn ..... 112/269.1 X 4,175,499 11/1979 Navlyt ..... 112/165

4,186,676 2/1980 Villa et al. ..... 112/165

4,250,824 2/1981 Meier et al. ..... 112/269.1

*Primary Examiner*—Peter P. Nerbun

*Attorney, Agent, or Firm*—Steele, Gould & Fried

[57] ABSTRACT

A thread chain sewing method and device for use in a two-needle overlock sewing machine. An inner chaining-off finger is held in an advanced position during sewing directly on fabric material. The inner finger is also advanced during the period at which thread chains are formed right after the sewing process passes the trailing edge of fabric material. The inner chaining-off finger is retracted from its advanced position alongside an outer chaining-off finger, in a direction opposite to a fabric material feeding direction, during other periods. The thread chains formed are wrapped only around the outer chaining-off finger before the leading edge of fabric but bridge over the inner and outer chaining-off fingers right after the trailing edge. The needle threads are automatically tightly tensioned during the sewing of fabric, the tension of the needle threads being automatically changed over to slightly tensioned for production of extensible thread chains.

10 Claims, 17 Drawing Figures

THREAD CHAIN SEWING METHOD AND DEVICE FOR USE IN THE TWO-NEEDLE OVERLOCK SEWING MACHINE

BACKGROUND OF THE INVENTION

The present invention relates to a thread chain sewing method and device for use in the two-needle overlock sewing machine.

Generally speaking, in the case where over-edging is performed by the overlock sewing machine along the edge of a segment of fabric material, continuous thread chains are also formed, extending from the fabric material when the sewing process is finished.

Therefore, a thread chain holding and cutting means is provided in front of the needle drop points of the one-needle overlock sewing machine and serves to hold the free end of the thread chains extending from the fabric material, which are then cut off from the fabric material when the sewing process is finished.

Thread chains thus held by the thread chain holding and cutting means on the one-needle machine can be automatically folded and sewn into the seam of a subsequent segment of fabric material, thus preventing the seam at the sewing-start portion of the fabric material from being frayed, and without requiring the back-tacking operation of a back-tacking machine.

However, the two-needle overlock sewing machine had a drawback that prevented thread chains from being automatically smoothly folded and sewn into the seam. Namely, in the process of automatically sewing previously formed thread chains into the seam, the newly formed thread chains, which are wrapped around the chaining-off fingers, are also folded and sewn into the seam.

The two-needle overlock sewing machine has two needles and two chaining-off fingers, each arranged at one side of the needle drop point of each of the needles, that is, the inner and outer chaining-off fingers are arranged parallel to and alongside each other at both sides of the needle drop point of the outer needle. Therefore, thread chains which are formed before the sewing operation of the sewing machine is applied to the fabric material are formed wrapped wide around the inner and outer chaining-off fingers. As the result, thread chains held by the thread chain holding and cutting means are sewn together with newly formed ones. Similarly, when being sewn into the seam, thread chains are sewn to the fabric material by the thread of the outer needle, thus preventing the sewing of thread chains into the seam, leaving the thread chains projecting past the edge of fabric material at the beginning of seams.

In order to eliminate these drawbacks which are often seen in the conventional two-needle overlock sewing machine, the inventors of the present invention have developed a thread chain sewing device for use in the two-needle overlock sewing machine wherein the inner chaining-off finger, which was conventionally fixed parallel to and alongside the outer chaining-off finger, is arranged to be retractable in a direction opposite to the fabric material feeding direction and is held in its retracted position during the non-sewing time, thus allowing thread chains to be formed wrapped only around the outer chaining-off finger before the sewing operation of the sewing machine reaches the fabric material and preventing these thread chains from being sewn to the fabric material by the thread of the outer needle during sewing, with the result that these thread chains can be smoothly folded and sewn into the seam.

However, according to test conducted using the device, it has become apparent that if the inner chaining-off finger is moved to its retracted position at the moment when the sewing operation is finished, that is, at the time when the trailing end of fabric material passes through the needle drop points, thread chains formed after sewing are not wrapped around the inner chaining-off finger so as to be symmetrical and beautiful, and cannot be therefore beautifully folded and sewn into the seam when the sewing operation is applied to a subsequent segment of fabric material.

In addition, in the case where assembly seaming such as over-edging is performed with the overlock sewing machine, it is necessary that the needle threads be tightly tensioned, different from the case of blind stitch hemming. In the case of the stitched network shown in FIG. 1, for example, the tension of each of the threads is set in such a way that each of the looper threads B and C is made 3.5–5 times longer than each of needle threads A and A'. Therefore, thread chains formed in this manner after the sewing operation are wide and have no satisfactory elasticity. Such chains are not narrow enough to be folded and sewn into the seam of a subsequent segment of fabric material, because needle threads A, A' and looper threads B, C, together forming the thread chains, are remarkably different in length.

SUMMARY OF THE INVENTION

An object of the present invention is therefore to provide a thread chain sewing method and device for use in the two-needle overlock sewing machine wherein thread chains are formed narrow in width and are not entangled and wrapped around the inner chaining-off finger, thus preventing thread chains held by the thread chain holding and cutting means from being sewn together with newly formed ones and from being sewn to the fabric material by the thread of the outer needle when being folded and sewn into the seam.

Another object of the present invention is to provide a thread chain sewing method and device for use in the two-needle overlock sewing machine wherein thread chains are formed symmetrically and beautifully bridging the inner and outer chaining-off fingers right after the trailing edge of fabric material is sewn and can be beautifully folded and sewn into the seam of a subsequent segment of fabric material.

Another object of the present invention is to provide a thread chain sewing method and device for use in the two-needle overlock sewing machine wherein needle threads are tightly tensioned during the sewing of fabric material, allowing assembly seaming such as over-edging to be reliably attained, and then slightly tensioned during the thread chain forming period before and after the sewing of fabric material, forming thread chains which are elastic and extensible, so that the thread chains thus formed can be smoothly and beautifully folded and sewn into the seam.

The term "sewing machine operation" as used herein represents the whole of the operating processes necessary to sew a sheet of fabric material. Namely, it represents a series of operating processes including the period of machine stoppage after sewing a previous fabric segment, the start of operation of the sewing machine, a second (leading) thread chain forming period, the sewing process being applied directly to the segment of fabric material, a first (trailing) thread chain forming period after the sewing process passes the trailing edge of material, and a period until the actual stop of operation of the sewing machine. The term "sewing process" represents the period in which over-edging is practically done relative to a segment of fabric material.

BRIEF DESCRIPTION OF THE DRAWINGS

FIGS. 13*a*–13*e* are views showing how thread chains are folded and sewn into the seam in the embodiment of the present invention.

DETAILED DESCRIPTION OF THE PREFERRED EMBODIMENT

Figure 1:
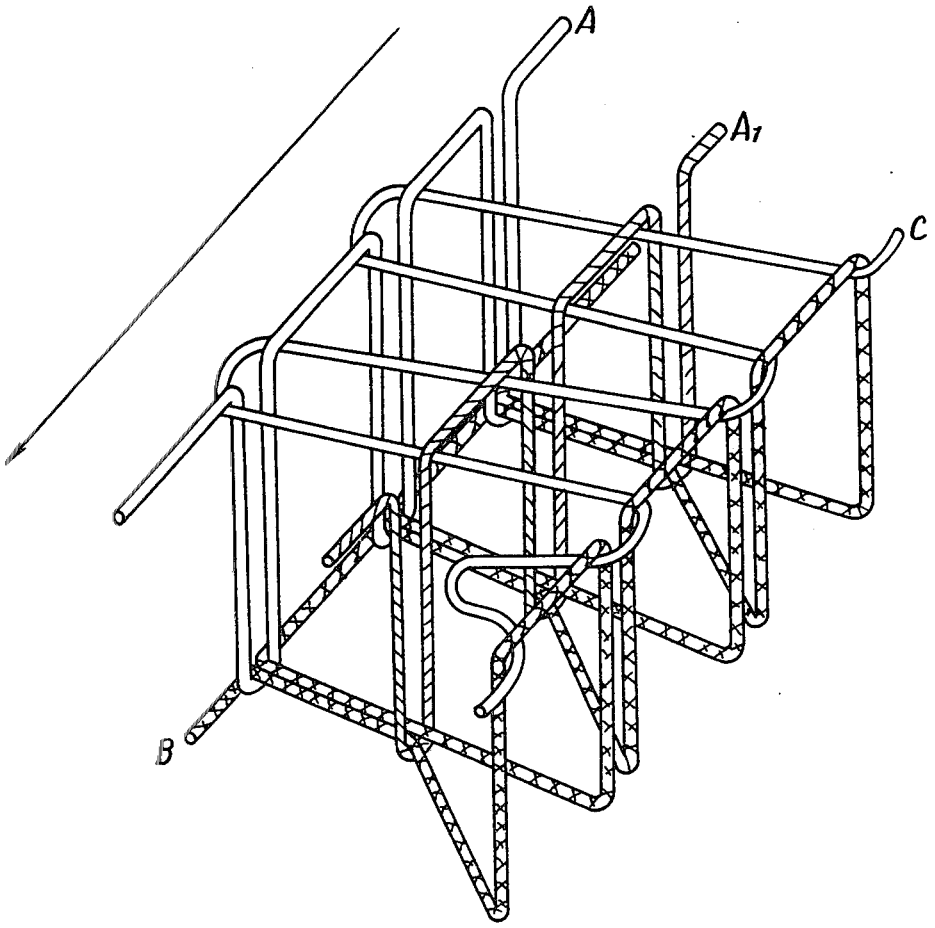
FIG. 1 is a view showing an over-edging stitching network in the case of two needle threads.
Figure 2:
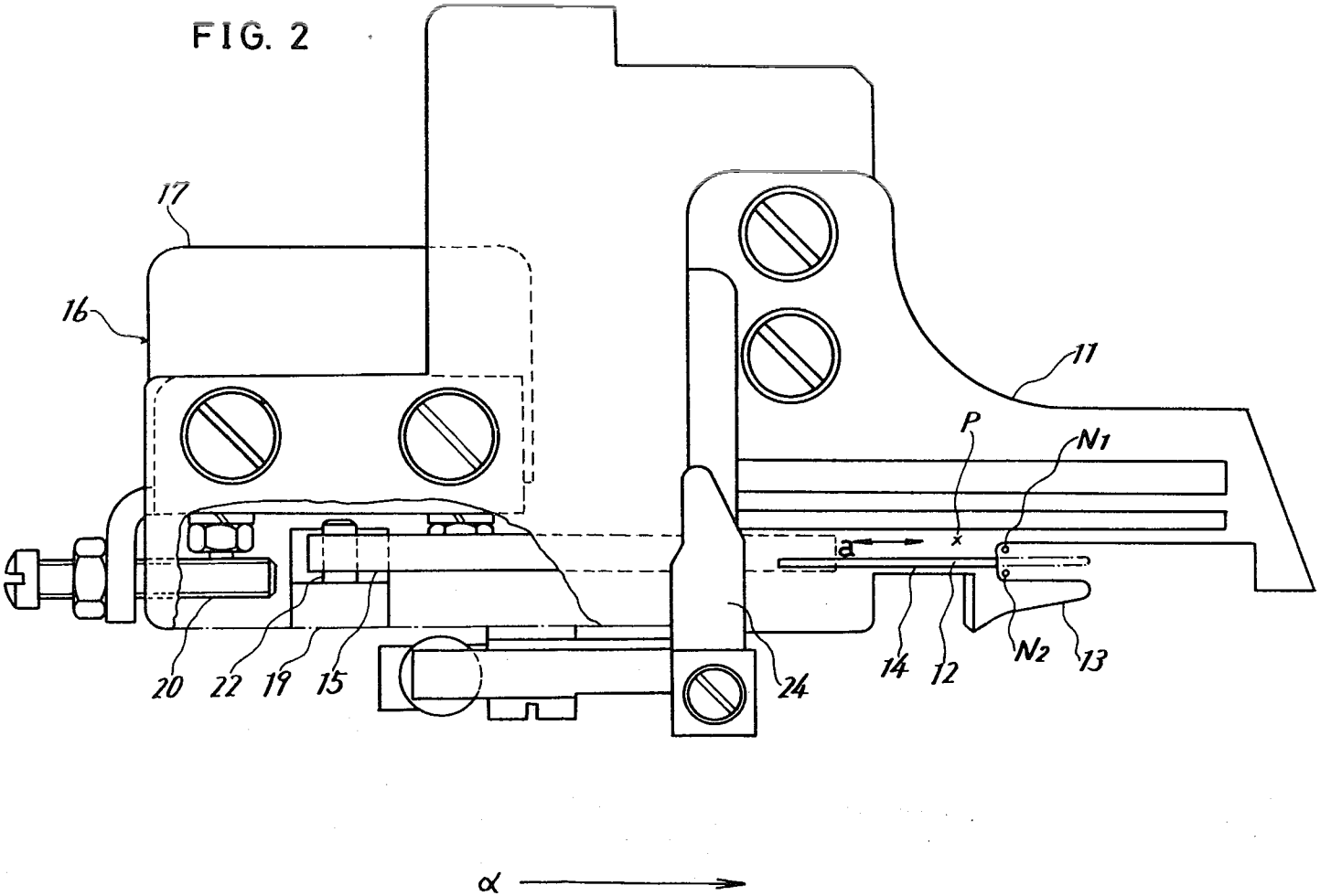
FIG. 2 is a plan view showing a needle plate portion employed in an embodiment of the present invention.
Figure 3:
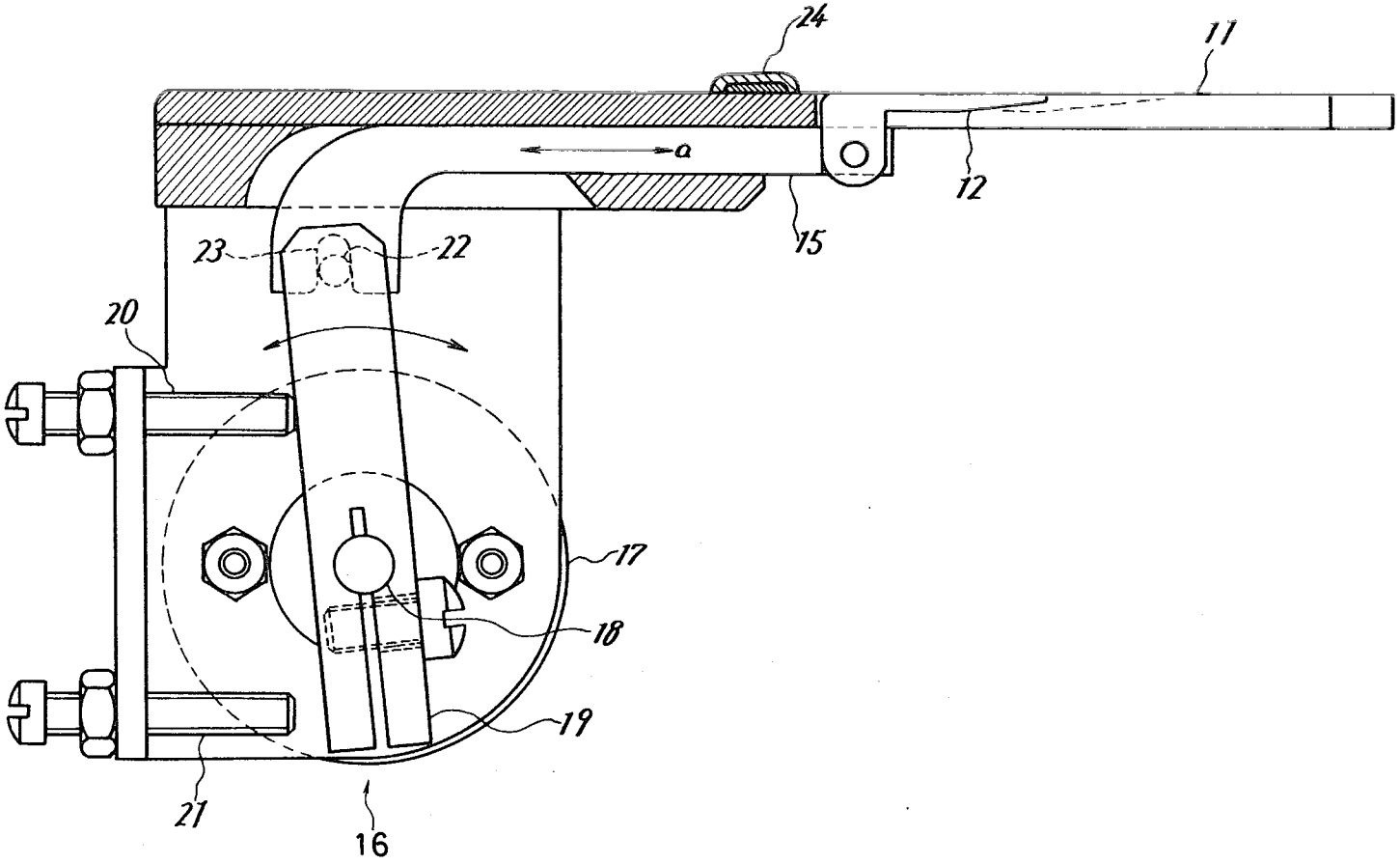
FIG. 3 is a side view of the needle plate portion.

In FIGS. 2 and 3, numeral 11 represents a needle plate of a two-needle overlock sewing machine. The inner one of inner and outer chaining-off fingers 12 and 13, which would normally be arranged as an integral part of the needle plate, outside (or below in FIG. 2) needle drop points $N_1$ and $N_2$ of needle plate 11, is arranged to be retractable, as shown by arrow a, from the position at which it is alongside the outer chaining-off finger 13, as shown by a dash-and-dot line in FIG. 2, to a position displaced therefrom in a direction approaching the operator and opposite to the fabric material feeding direction $\alpha$. The inner chaining-off finger 12 is formed separate from the needle plate 11 rather than integral therewith. A slit 14, through which the inner chaining-off finger 12 is allowed to retract, is provided in the needle plate 11; a slide lever 15 is arranged at the back-side of needle plate 11 so as to freely reciprocally slide along the slit 14; and, the inner chaining-off finger 12 is fixed to the foremost end of lever 15.

The inner chaining-off finger 12 is reciprocated by means of a driving means 16, through the slide lever 15. The driving means 16 comprises a driving lever 19, the middle portion of which is fixed to the rotating shaft 18 of a rotary solenoid 17, and stops 20 and 21, each of which contacts driving lever 19 at the ends thereof, so as to limit the rotary angle of driving lever 19. The driving lever 19 is urged in the counter-clockwise direction in FIG. 3 by means of a coil spring (not shown) fitted onto the rotating shaft 18 of lever 19. A pin 22, projecting from the upper side of driving lever 19, is engaged with a hole 23, provided in the lowermost end of the lower L-shaped portion of slide lever 15.

A thread chain cutting and holding means 24 is arranged at a position spaced a certain distance toward the operator from needle drop points $N_1$ and $N_2$ of needle plate 11. The means 24 is of conventional type commonly used for one-needle overlock sewing machines or the like.

Figure 4:
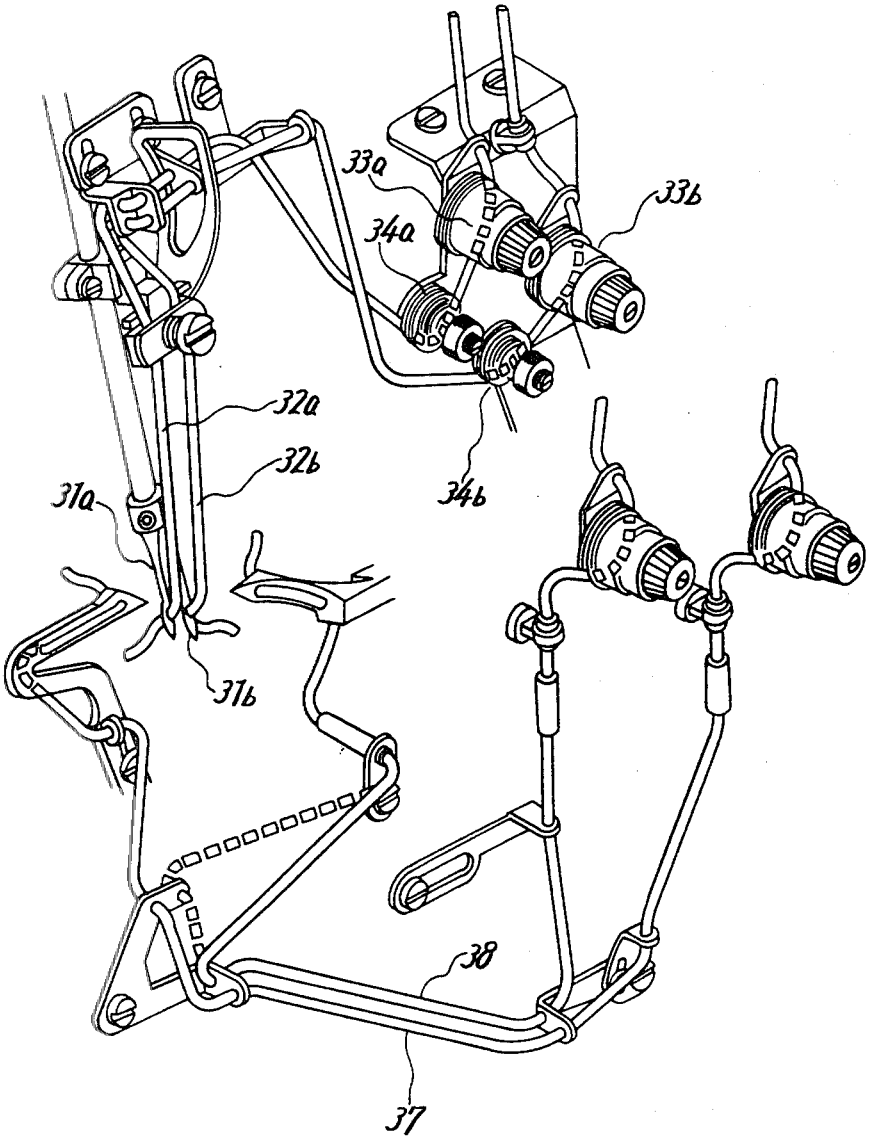
FIG. 4 is a partial perspective view, showing how the needle threads are guided in the embodiment of the present invention.
Figure 5:
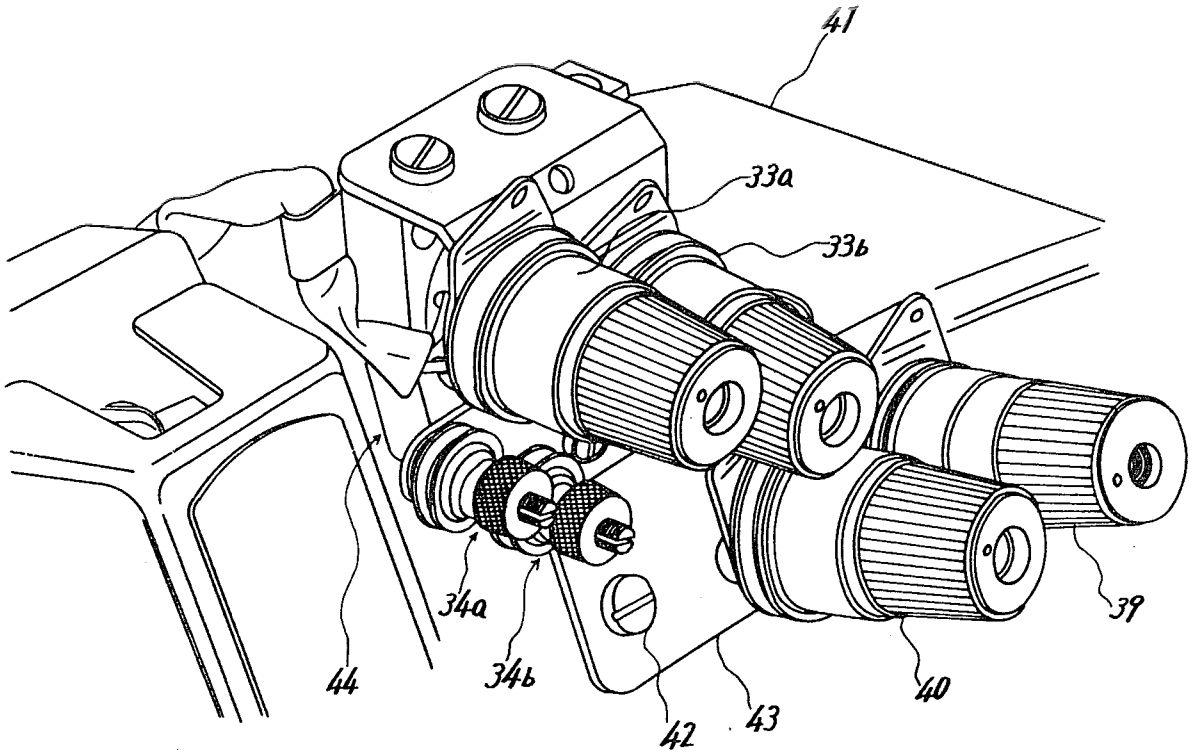
FIG. 5 is a perspective view showing thread-tensioning members in the embodiment of the present invention.

As shown in FIG. 4, pairs of thread-tensioning members 33*a* and 34*a*, and 33*b* and 34*b*, are arranged in each of the paths through which threads 32*a* and 32*b* are guided to needles 31*a* and 31*b*. Members 33*a* and 33*b* tension tightly, under control; members 34*a* and 34*b* tension slightly. Tight thread-tensioning members 33*a*, 33*b* and slight thread-tensioning members 34*a*, 34*b* are attached to the upper surface of a base plate 43, which is fixed to the sewing machine body 41 by means of a screw 42, as shown in FIG. 5. To the back-side of base plate 43 is attached a thread tension changeover means 44, which serves to change the tension of threads guided by tight thread-tensioning members 33*a* and 33*b* between two different states, one of said states being to keep the threads tightly tensioned and the other to only slightly tension the threads.

Figure 6:
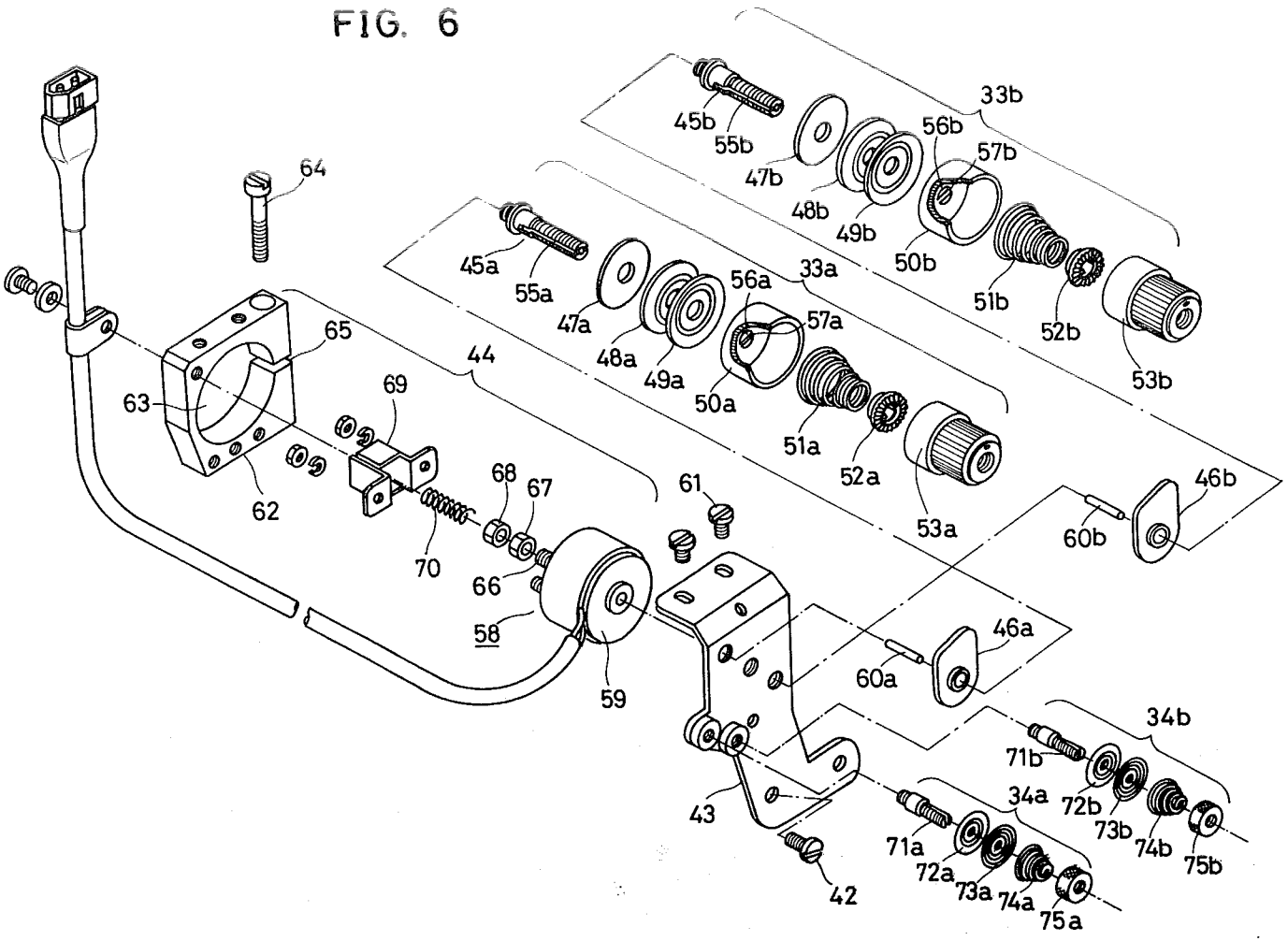
FIG. 6 is a perspective assembly view showing the thread-tensioning members for tight and slight tension, and the thread tension changeover means in the embodiment of the present invention.
Figure 7:
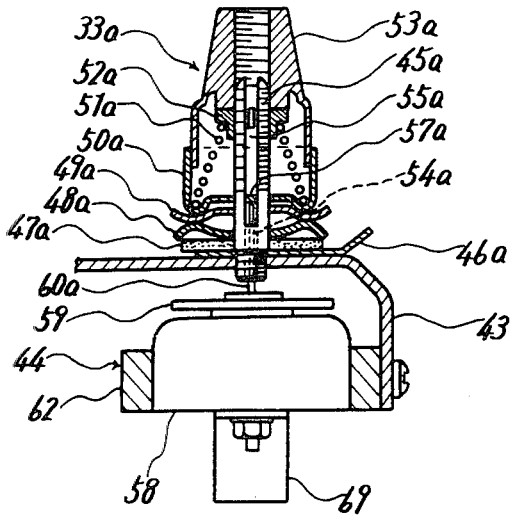
FIG. 7 is a sectional view of the tight thread-tensioning member employed in the embodiment of the present invention.

As shown in FIGS. 6 and 7, the tight thread-tensioning member 33*a* or 33*b* comprises a screw rod 45*a* or 45*b* screwed into the base plate 43, a plate 46*a* or 46*b* screwed onto that portion of the screw rod which projects from the base plate 43, and a nut 53*a* or 53*b* screwed onto the foremost end of the screw rod, with a felt washer 47*a* or 47*b*, plates 48*a* or 48*b* and 49*a* or 49*b*, spring receiver 50*a* or 50*b*, spring 51*a* or 51*b* and stopper ring 52*a* or 52*b* interposed in this order between plate 46*a* or 46*b* and nut 53*a* or 53*b*.

A hole 54*a* or 54*b* is provided along the axial center of that lower portion of screw rod 45*a* or 45*b* which projects from the back-side of base plate 43, and a slit 55*a* or 55*b*, is provided in that upper portion of screw rod 45*a* or 45*b* onto which the spring receiver 50*a* or 50*b* is fitted. Into the slit 55*a* or 55*b* is inserted a bridge portion 57*a* or 57*b* bridging a hole 56*a* or 56*b* in spring receiver 50*a* or 50*b* through which the screw rod 45*a* or 45*b* is inserted.

The thread tension changeover means 44 includes an electromagnetic solenoid 58 of the attractive type, arranged at the back-side of base plate 43 with its disc-shaped plunger 59 facing the screw rod 45*a* or 45*b*, and a pin 60*a* or 60*b* inserted into the hole 54*a* or 54*b* of screw rod 45*a* or 45*b*, and pressed by the plunger 59 so as to urge the spring receiver 50*a* or 50*b* against the action of spring 51*a* or 51*b*. The electromagnetic solenoid 58 is held by a holder 62 which is attached to the base plate 43 by means of a screw 61. Namely, the electromagnetic solenoid 58 is fitted into a hole 63 of holder 62 and fastened therein by screwing a bolt 64 into a split portion 65 of holder 62. The electromagnetic solenoid 58 is continuously connected to the plunger 59, and lock nuts 67 and 68 are screwed onto an adjusting rod 66 projecting from the side opposite to the plunger 59 so as to adjust the distance that plunger 59 projects toward the screw rod 45*a* or 45*b*. A spring receiving metal member 69 is nut-fastened to the foremost end of adjusting rod 66 with a coil spring 70 interposed between metal member 69 and nut 68 to thereby urge the plunger 59 toward the screw rod 45*a* or 45*b*.

The slight thread-tensioning member 34*a* or 34*b* comprises a screw rod 71*a* or 71*b* screwed into the base plate 43 obliquely below the tight thread-tensioning member 33*a* or 33*b*, a combination of plate 72*a* or 72*b*, another plate 73*a* or 73*b* and spring 74*a* or 74*b* fitted in this order onto the screw rod 71*a* or 71*b*, and a nut 75*a* or 75*b* screwed onto the foremost end of screw rod 71*a* or 71*b*.

In addition, a fabric material detection means or sensor 76 and a pulse generator 77 are provided, said detection means serving to detect the presence of a fabric material at the needle drop points $N_1$ and $N_2$ of sewing machine body 41, and said pulse generator serving to generate a pulse signal synchronized with the stitching operation of needles 31*a* and 31*b*.

Figure 8A:
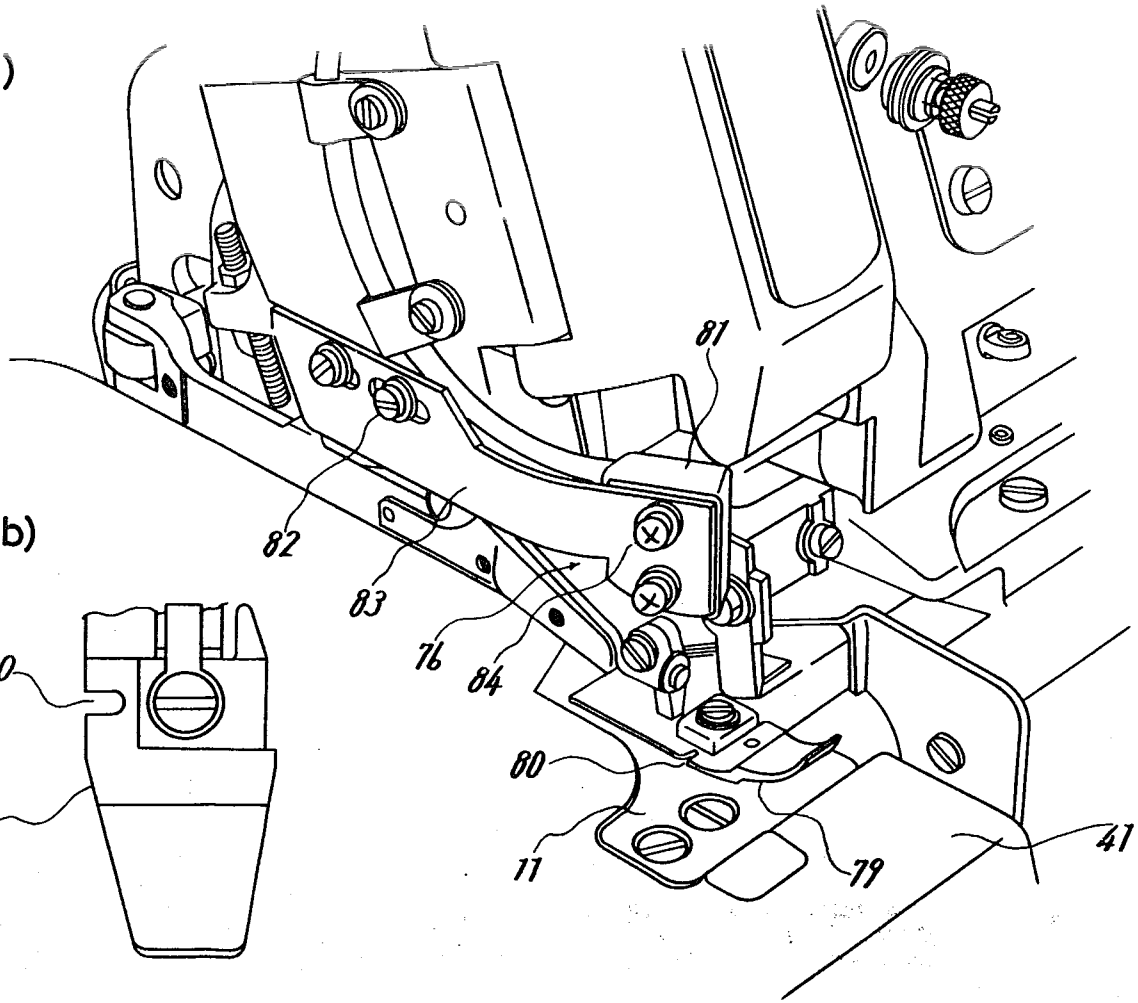
FIG. 8*a* is a perspective view showing a fabric material detection section in the embodiment of the present invention.
Figure 8B:
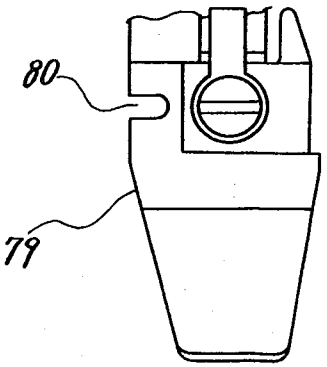
FIG. 8*b* is a plan view of a pressing plate.
Figure 9:
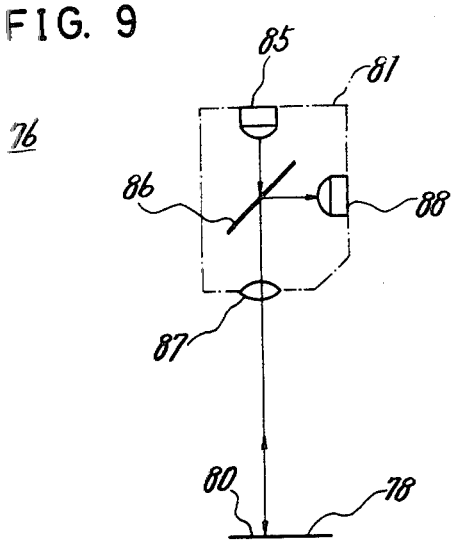
FIG. 9 is a schematic view showing a photo-sensor in the embodiment of the present invention.

As shown in FIGS. 8*a* and 8*b*, a recess 80 is formed at the edge of a pressing plate 79 positioned over the needle plate 11, said recess 80 being positioned nearer the operator than the needle drop points are. A photo-sensor 81 is arranged right above the recess 80. The photo-sensor 81 is attached by a screw 84 to the foremost end portion of an auxiliary plate 83 which is attached to the sewing machine body 41 by a screw 82. As shown in FIG. 9, the photo-sensor 81 includes a light-emitting diode 85 arranged right above the recess 80, a semi-transparent mirror 86 slanted by 45 degrees from the light-emitting diode 85, a condensing lens 87, and a phototransistor 88 shifted by 90 degrees from the diode 85. The light emitted from the diode 85 passes through the semitransparent mirror 86, condensing means 87 and recess 80, and is reflected by the upper surface of needle plate 11 to the phototransistor 88, again through the condensing lens 87 and semitransparent mirror 86. The fabric material detection means 76 thus formed serves to detect the presence of fabric material at the recess 80 responsive to the brightness of reflected light since the light reflected by the mirror-like surface of needle plate 11 is low in brightness when the fabric material is present at the recess 80 but high when no fabric material is present there.

Figure 10:
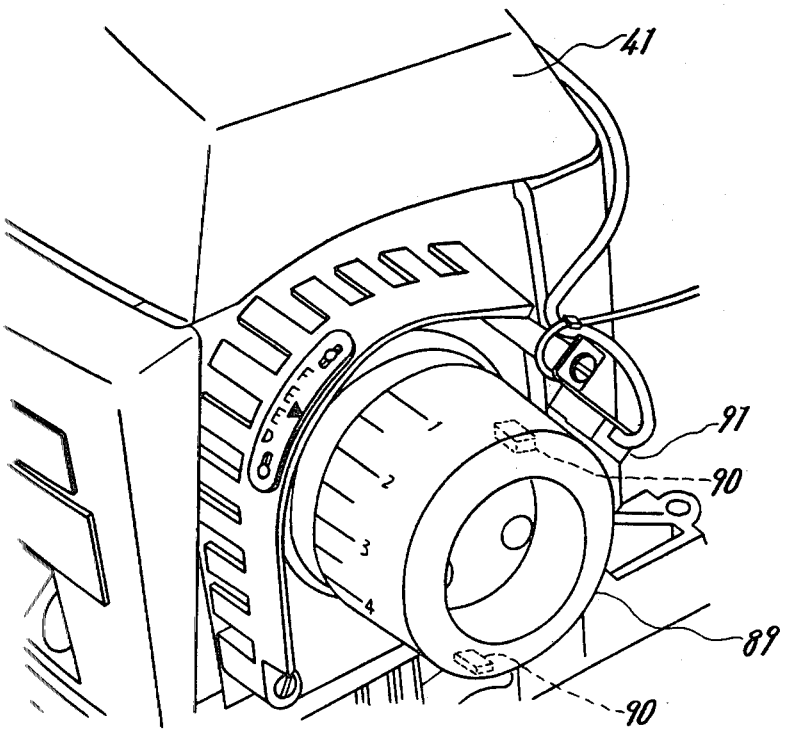
FIG. 10 is a perspective view showing a rotating pulse generator in the embodiment of the present invention.

With reference to FIG. 10, the pulse generator 77 is directly attached to a crankshaft (not shown) of sewing machine body 41 and includes a pulley 89 which rotates synchronously with the stitching operation of needles 31*a* and 31*b*. Pulley 89 has two permanent magnets embedded therein opposite to each other, and a magnetic sensor 91 is arranged adjacent to the pulley 89. The pulse generator 77 is designed to generate two pulses for every revolution of pulley 89, that is, for every stitching operation of needles 31*a* and 31*b*. The reason why two pulses are generated every stitching operation is to increase the timing precision during changing the tension of threads 32*a* and 32*b*, driving the inner chaining-off finger 12 forward, and changing over from the formation of thread chain to the start of assembly seaming at the edge of fabric material. When a pulse is generated every stitch, for example, there is a maximum possible error corresponding to one stitch. However, when two pulses are generated for every one stitch, it is possible to reduce the error to maximum of half a stitch. Therefore, the timing precision will be enhanced as the number of pulses generated for every stitch operation increases.

Figure 11:
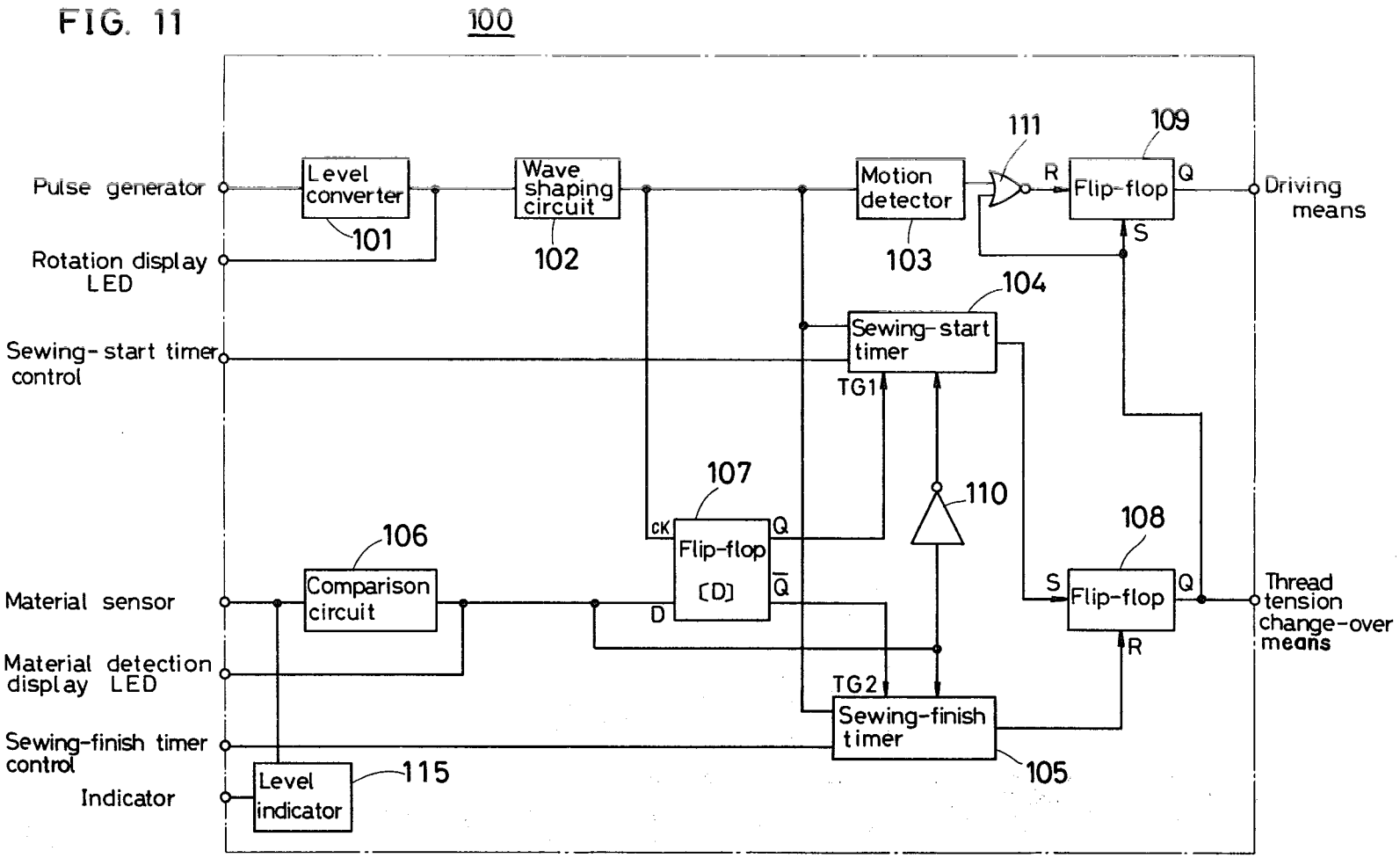
FIG. 11 is a block diagram of a control circuit employed in the embodiment of the present invention.
Figure 12:
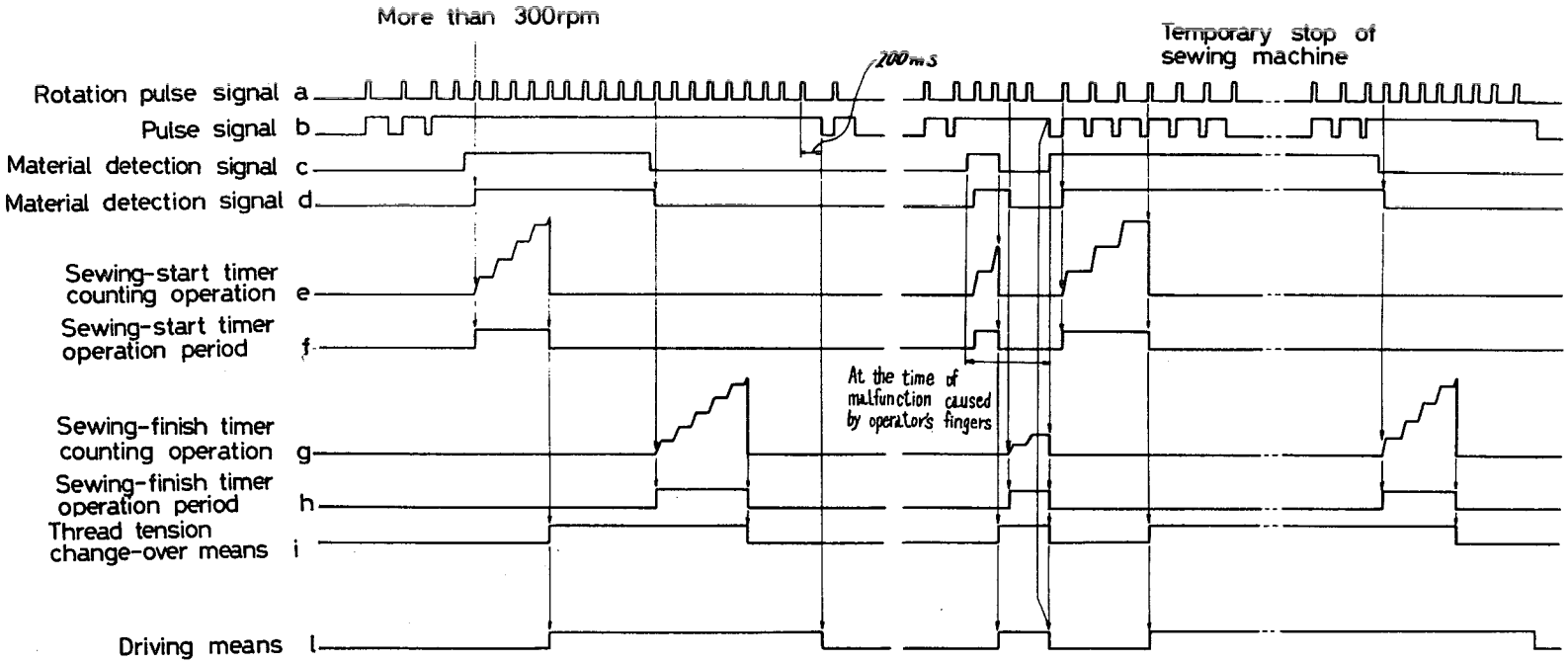
FIG. 12 is an operation timing chart of the embodiment of the present invention.

FIG. 11 shows a block diagram of a control circuit 100. Pulses from the pulse generator 77 are applied through a level converter 101 to a wave form shaping circuit 102 and, after pulse duration and level are shaped to certain values, to a motion detector 103, and sewing-start and -finish timers 104 and 105, respectively, said motion detector forming a stitch operation detection means and said sewing-start and -finish timers forming a delayed operation means. The level converter 101 serves to convert the output level of pulse generator 77 to the input level of control circuit 100.

Output voltages from the phototransistor 88 of fabric material sensor 76 are applied to a comparison circuit 106. The comparison circuit 106 applies a fabric material detection signal (c) to a flip-flop 107 when the output voltage from the phototransistor 88 becomes lower than a predetermined reference voltage $E_s$, that is, when the fabric material sensor 76 detects the fabric material. Conversely, the circuit 106 stops the emission of the output signal when the output voltage from the phototransistor 88 becomes higher than the predetermined reference voltage $E_s$, that is, when the fabric material sensor 76 detects no fabric material. The reference voltage $E_s$ can be adjusted according to the kinds of fabric material employed.

The flip-flop 107 gives a start signal to a trigger gate $TG_1$ of sewing-start timer 104 upon receiving the fabric material detection signal (c) from the comparison circuit 106, but gives the start signal to a trigger gate $TG_2$ of sewing-finish timer 105 when the output signal from the comparison circuit 106 becomes zero.

When receiving the start signal from the flip-flop 107, the sewing-start timer 104 starts to count pulses on the pulse signal (a) and gives a net signal to a flip-flop 108 when the counted number becomes equal to a predetermined one. Upon receiving the set signal, the flip-flop 108 applies an exciting signal to the electromagnetic solenoid 58 of thread tension changeover means 44 and a set signal to a flip-flop 109. The flip-flop 109 then gives an exciting signal to the rotary solenoid 17 of driving means 16 which drives the inner chaining-off finger 12.

Upon receiving the start signal from the flip-flop 107, the sewing-finish timer 105 starts to count the pulses on pulse signal (a) sent from the shaping circuit 102 and gives a reset signal to the flip-flop 108 to release the electromagnetic solenoid 58 of thread tension changeover means 44 from its excited state when the counting number equals a predetermined one. Sewing-start and -finish timers 104 and 105 are reset by the output signal of comparison circuit 106 in such a way that the output signal is applied directly to the sewing-finish timer 105 and via a "NOT" circuit 110 to the sewing-start timer 104. The motion detector 103, together with the pulse generator 77, forms the stitching operation detection means, comparing the frequency or period of pulse signal (a) sent from the shaping circuit 102 with a predetermined value, and generating a timing signal to de-energize the driving means 16 when the frequency or period of pulse signal (a) becomes lower or longer than the predetermined value. In this case, the motion detector 103 generates a pulse signal (b) having a certain pulse duration synchronized with the pulse signal (a). When the stitching operation of the sewing machine becomes faster and the interval between pulses of pulse signal (a) becomes shorter than the pulse duration of pulse signal (b), the motion detector 103 generates signal (b) continuously, but when the stitching operation of the sewing machine becomes slower and the interval between pulses of pulse signal (a) becomes longer than the pulse duration of pulse signal (b), signal (b) becomes intermittent. In the case of the embodiment shown, pulse signal (b) becomes continuous when the rotating member of pulley 89 of pulse generator 77 exceeds about 300 rpm, but intermittent when the interval between pulses of pulse signal (a) becomes more than 200 ms.

The motion detector 103 applies pulse signal (b) through one input of a "NOR" gate 111 to the flip-flop 109 and gives the reset signal to the flip-flop 109 at the time pulse signal (b) falls, that is, at the time of changeover from a continuous output to an intermittent one, to thereby reset the flip-flop 109, releasing the rotary solenoid 17 of driving means 16 from excited state. The set signal of flip-flop 108 is applied to the other input of "NOR" gate 111 to prevent the inner chaining-off finger 12 from retracting when the flip-flop 108 is in set condition, that is, when the fabric material is present at needle drop points $N_1$ and $N_2$. Sewing-start and -finish timers 104 and 105 are provided with sewing-start and -finish time controls, respectively, for determining their preset times or counts.

To the outputs of level converter 101 and comparison circuit 106 are connected rotation display LED and fabric material detection display LED (not shown) for displaying the pulse signal (a) and the fabric material detection signal (c), respectively.

The output level of phototransistor 88 of fabric material sensor 76 is displayed by a level indicator 115.

Figure 13A:
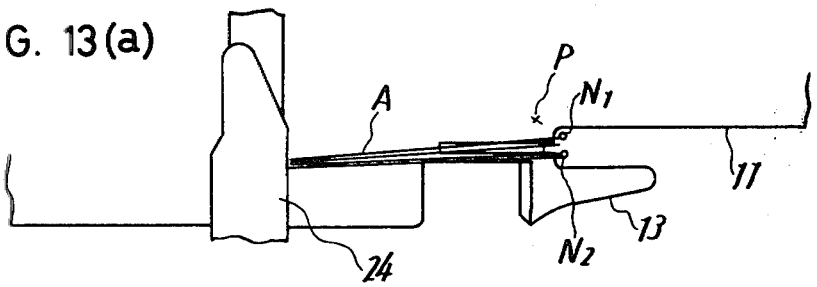
Figure 13B:
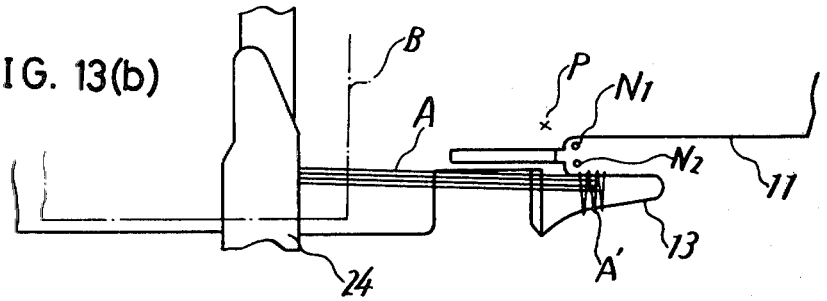

According to the embodiment of the present invention described above, continuous thread chains A, attached to the fabric material, are cut off from the fabric material by the thread chain cutting and holding means 24 at the time sewing is finished on a fabric segment, to thereby release the fabric material from the sewing machine. The cut end of thread chain A, left on the sewing machine, is held by the thread chain cutting and holding means 24 with the inner chaining-off finger 12 retracted as shown in FIG. 13*a*.

When another fabric material segment B to be sewn is set on the sewing machine and the sewing machine is operated, thread chains A', continuous from thread chain A, held by the means 24, are formed wrapped only around the outer chaining-off finger 13. When the leading edge of fabric material B reaches a point P, namely, the irradiation point of photo-sensor 81, the sewing-start timer 104 of control circuit 100 starts to count pulses on the pulse signal (a). Therefore, if the sewing-start timer 104 is previously set by the sewing-start time control to a certain value at which timing the leading end of fabric material B reaches the needle drop points $N_1$ and $N_2$ and the sewing operation commences on fabric material B, the timer 104 gives a set signal to the flip-flop 108 to excite the electromagnetic solenoid 58 of thread tension changeover means 44 and the flip-flop 109 is brought into a set state at the same time to excite the rotary solenoid 17 of driving means 16.

The plunger 59 of electromagnetic solenoid 58 is drawn against the action of coil spring 70 to release plates 50*a* and 50*b* from the pressure caused by pins 60*a* and 60*b*, so that the force of springs 51*a* and 51*b* acts on plates 49*a* and 49*b* through spring receivers 50*a* and 50*b* to thereby cause tight thread-tensioning members 33*a* and 33*b* to attain their thread-tensioning function, respectively (i.e., thread tension is increased).

The rotating shaft 18 of rotary solenoid 17 is rotated to move the driving lever 19 in the clockwise direction in FIG. 3 and the inner chaining-off finger 12 is therefore advanced to a position alongside the outer chaining-off finger 13 by means of slide lever 15 driven by the driving lever 19.

Figure 13C:
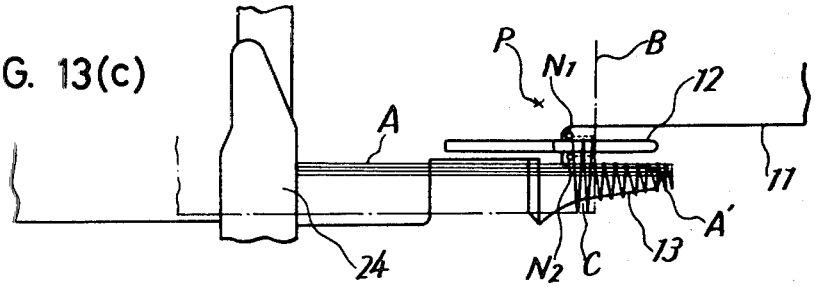

As the result, threads 32*a* and 32*b* are tightly tensioned by tight thread-tensioning members 33*a* and 33*b* and sewing or over-edging of the edge of the fabric material B is attained during the inner and outer chaining-off fingers 12 and 13, positioned alongside one another as shown in FIG. 13*c*, thus making it possible to sew thread chains A into a seam C.

Figure 13D:
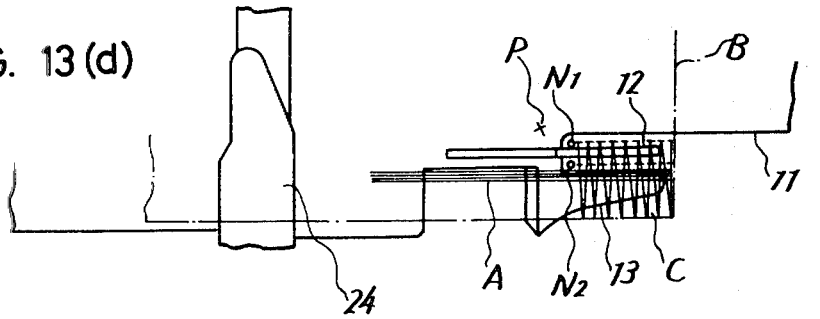

In this case, thread chains A', formed before the sewing of fabric material B, are tangled only around the outer chaining-off finger 13. Chains A' are thus narrow in width, the same as those formed by the one-needle overlock sewing machine, and are positioned outside the outer needle drop point $N_2$. Therefore, thread chains A' can be smoothly and reliably folded and sewn into the seam C without causing thread chains held by the thread chain cutting and holding means to be sewn with newly formed ones, which was often seen in the conventional cases, or causing thread chains to be sewn onto the fabric material by the thread guided through the outer needle. As the sewing progresses to completely sew the portion of thread chains A' into the seam C, the tension acting on thread chain A operates to overcome the thread chain holding force of means 24 to thereby release thread chains A from the means 24 and thread chains A are also folded and sewn into the seam C as shown in FIG. 13*d*.

When the trailing end of fabric material B passes through the point P, the sewing-finish timer 105 of control circuit 100 starts to count pulses on the pulse signal (a) and gives a reset signal to the flip-flop 108 to de-energize the electromagnetic solenoid 58 of thread tension changeover means 44 at the time when the trailing end of fabric material B reaches needle drop points $N_1$ and $N_2$. At that time, the plunger 59 together with the spring 70 pushes spring receivers 50*a* and 50*b* away from plates 49*a* and 49*b* by means of pins 60*a* and 60*b* to thereby render tight thread-tensioning members 33*a* and 33*b* inoperative of their thread-tensioning function (i.e., thread tension is decreased).

The normal tension of threads 32*a* and 32*b* is adjusted by slight thread-tensioning members 34*a* and 34*b* and when the sewing machine is operated in this state (low tension), thread chains are formed in such a way that the length of needle threads 32*a* and 32*b* becomes substantially equal to that of looper threads 37 and 38.

The flip-flop 109 is still held in set state and the inner chaining-off finger 12 is kept advanced as shown in FIG. 13*e*. Thread chains are therefore formed bridging both the inner and outer chaining-off fingers 12 and 13. In addition, since the length of needle threads 32*a* and 32*b* is about equal to that of looper threads 37 and 38, thread chains thus formed have elasticity in the direction of tension, are symmetrical and beautiful, and are extensibly thinner and longer when being drawn out. Therefore, these thread chains can be reliably and beautifully folded and sewn into the seam of a subsequent segment of fabric material.

When the stitching operation of the sewing machine becomes slow and the inverval between pulses of pulse signal (a) becomes more than 200 ms, the pulse signal (b) from the motion detector 103 falls and the flip-flop 109 is reset to break the excitation of rotary solenoid 17 of driving means 16. The inner chaining-off finger 12 is then retracted into the slit 14 by the action of the return spring. When continuous thread chains A, attached to the fabric material B, are then held and cut by the thread chain cutting and holding means 24, automatic sewing of thread chains can be again attained in same way as described above in the next subsequent sewing procedure.

As apparent from the above, according to the present invention the inner chaining-off finger 12 is retractable and held retracted until the sewing operation of the sewing machine is to be started, so that leading thread chains formed before the start of a sewing operation are not wrapped or entangled around the inner chaining-off finger 12, are narrow in width, and may be smoothly and reliably sewn into the seam of the fabric material.

The inner chaining-off finger 12 is advanced and held at the time when the sewing operation is started on a segment of fabric, and still held there after the fabric segment is passed, when thread chains are formed. In addition, needle threads are tightly tensioned at the same time when the sewing operation is started on a fabric segment and then slightly tensioned by means of the thread tension changeover means at the time when the sewing operation ends at the trailing edge of fabric and thread chains are formed. Accordingly, trailing thread chains are symmetrical, elastic, extensible and beautifully sewn into the seam of a subsequent segment of fabric material. Moreover, since the tension of the needle threads is held tight during the sewing operation on the fabric, assembly seaming such as over-edging can be reliably attained.

It will be understood that fine adjustment of the thread tension for performing assembly seaming and for forming thread chains can be achieved by adjusting each of nuts 53*a*, 53*b* and 75*a*, 75*b* of tight and slight thread-tensioning members 33*a*, 33*b* and 34*a*, 34*b*.

Even if the sewing machine is temporarily stopped during the sewing process, in the middle of a fabric segment, flip-flops 108 and 109 are kept in set state and thread tension changeover means 44 and driving means 16 are ready to continue the sewing operation until the trailing end of fabric material is detected by the fabric material sensor 76. Therefore, keeping this state, the sewing operation may be instantly started again.

What is claimed is:

1. A device for backtacking thread chains in a two-needle overlock sewing machine having an outer chaining-off finger and an inner chaining-off finger, and a pair of thread-carrying needles arranged to drop one on either side of the inner chaining-off finger, comprising:

means for controllably retracting the inner chaining-off finger from an advanced position in which it is kept alongside the outer chaining-off finger, said means for retracting having means for driving the inner chaining-off finger forward and backward in a fabric feed direction, and for holding it in its advanced and retracted positions;

a thread tension changeover mechanism for controllably tensioning each of said needle threads tightly and slightly;

a fabric material detection means for detecting whether the fabric material is present at the needle drop points;

a stitching operation detection means for detecting operation of the sewing machine; and, a control circuit for causing the driving means and the thread tension changeover mechanism to operate to hold the inner chaining-off finger in its advanced position and to change over the tension of each of the needle threads from a slightly tensioned state to a tightly tensioned state when fabric material is detected by the fabric material detection means, said control circuit also causing the thread tension changeover means to operate to change over the tension of each of the needle threads from the tightly tensioned state to the slightly tensioned state when the fabric material is not detected by the fabric material detection means, and said control means also causing the driving means to hold the inner chaining-off finger in its retracted position when the operation of the sewing machine is not detected by the stitching operation detection means.

2. A thread chain backtacking device according to claim 1, wherein the thread tension changeover mechanism includes a pair of thread-tensioning members arranged in a path defined by each of the needle threads, one of said pair being connected to the thread tension changeover means for rendering the function of said one of said pair of thread-tensioning member operative and inoperative alternately, the other of said pair setting the thread tension when one said one of said pair is inoperative.

3. A thread chain backtacking device according to claim 1, wherein the stitching operation detection means comprises a pulse generator for generating a pulse synchronized with the stitching operation of the sewing machine, and a motion detector arranged in the control circuit for comparing the frequency of pulses generated by the pulse generator with a predetermined value and giving a timing signal to the control means to cause the driving means to retract the inner chaining-off finger when the frequency of pulses becomes lower than the predetermined value.

4. A thread chain backtacking device according to claim 3, wherein the pulse generator includes a pulley rotating synchronously with the stitching operation of the sewing machine, said pulley having at least one magnet embedded therein, and a magnetic sensor arranged adjacent to the pulley.

5. A thread chain backtacking device according to claim 1, wherein the fabric material detection means is a fabric material sensor arranged before the needle drop points in the fabric feed direction, and the control circuit includes a delay operation means for generating a timing signal to delay the operation of the driving means and the thread tension changeover mechanism for a predetermined time from a time the starting end of the fabric material is detected by the fabric material sensor and another timing signal to cause the thread tension changeover means to change over to slight tension after the lapse of a predetermined time from a time the trailing end of fabric material is detected by the fabric material sensor.

6. A thread chain sewing device according to claim 5, wherein the delay operation means is a timer responsive to an output signal of the fabric material sensor, the timer generating the timing signals when the pulses of the pulse generator are counted to a predetermined number.

7. A thread chain backtacking method for use with a two-needle overlock sewing machine of the type having an outer chaining-off finger and an inner chaining-off finger, the fingers being mounted on a needle plate, needle drop points in the needle plate being positioned on both sides of the inner finger, the method comprising the steps of:

arranging the inner chaining-off finger to be controllably retractable in a direction opposite a fabric feed direction, from an advanced position parallel to and alongside the outer chaining-off finger;

arranging threads fed to the needles to be controllably tensionable at tight tension during sewing directly on a segment of fabric material and at slight tension otherwise;

holding the inner chaining-off finger in its advanced position during a predetermined portion of sewing machine operation, whereby a stitch network is formed bridging the inner and outer fingers; and, retracting said inner chaining-off finger during a second portion of sewing machine operation, whereby a stitch network is formed bridging only the outer chaining-off finger.

8. A thread chain backtacking method according to claim 7, wherein the inner chaining-off finger is held in its advanced position at least during stitching directly on a segment of fabric material.

9. A thread chain backtacking method according to claim 7, wherein the inner chaining-off finger is held in its advanced position during sewing directly on a segment of fabric material and also a period during which thread chains trailing from the segment are formed right after the sewing process passes a trailing edge of the fabric material.

10. A thread chain backtacking method according to claim 8, wherein the inner chaining-off finger is retracted when the rate of forming stitch networks falls below a predetermined rate.

* * * * *

UNITED STATES PATENT AND TRADEMARK OFFICE

CERTIFICATE OF CORRECTION

PATENT NO. : 4,356,782

DATED : November 2, 1982

INVENTOR(S) : Yoshinari Ueyama et al

It is certified that error appears in the above-identified patent and that said Letters Patent are hereby corrected as shown below:

Column 10, line 21, between "when" and "said" delete "one".

Signed and Sealed this

Tenth Day of May 1983

[SEAL]

*Attest:*

GERALD J. MOSSINGHOFF

*Attesting Officer*

*Commissioner of Patents and Trademarks*